US006808571B2

(12) United States Patent
Tanaka et al.

(10) Patent No.: US 6,808,571 B2
(45) Date of Patent: Oct. 26, 2004

(54) HEAT RESISTANT CARBURIZED ROLLING BEARING COMPONENT AND MANUFACTURING METHOD THEREOF

(75) Inventors: Hiromasa Tanaka, Kuwana (JP); Kikuo Maeda, Kuwana (JP); Tosiya Kinami, Nagoya (JP); Sadayuki Nakamura, Nagoya (JP)

(73) Assignee: NTN Corporation, Osaka (JP)

( * ) Notice: Subject to any disclaimer, the term of this patent is extended or adjusted under 35 U.S.C. 154(b) by 0 days.

(21) Appl. No.: 09/930,172

(22) Filed: Aug. 16, 2001

(65) Prior Publication Data

US 2002/0050308 A1 May 2, 2002

(30) Foreign Application Priority Data

Aug. 22, 2000 (JP) ..... 2000-251390

(51) Int. Cl.[7] ..... C21D 9/40
(52) U.S. Cl. ..... 148/663
(58) Field of Search ..... 148/333, 337, 148/319, 629, 663

(56) References Cited

U.S. PATENT DOCUMENTS 4,696,581 A * 9/1987 Tsushima et al. ..... 384/491
4,885,905 A * 12/1989 Maruta et al. ..... 57/119
4,913,749 A * 4/1990 Hengerer et al. ..... 418/201.1
5,413,643 A * 5/1995 Murakami et al. ..... 148/319
5,595,610 A * 1/1997 Maeda et al. ..... 148/233
5,910,223 A * 6/1999 Tipton et al. ..... 148/210
5,997,661 A * 12/1999 Matsumoto et al. ..... 148/316
6,101,719 A * 8/2000 Kiuchi et al. ..... 148/225
6,197,128 B1 * 3/2001 Maeda ..... 148/319
6,306,227 B2 * 10/2001 Okayama et al. ..... 148/233

FOREIGN PATENT DOCUMENTS

EP 0933440 A1 * 8/1999 ..... C22C/38/00
GB 2235698 * 3/1991 ..... C22C/38/18
JP 03-153842 A * 7/1991 ..... C23C/8/32

* cited by examiner

*Primary Examiner*—Roy King
*Assistant Examiner*—Harry D Wilkins, III
(74) *Attorney, Agent, or Firm*—McDermott Will & Emery LLP

(57) ABSTRACT

A heat resistant carburized rolling bearing component is formed of a steel material at least containing, as alloy elements in a matrix, by mass %, at least 0.1% and at most 0.4% of C, at least 0.3% and at most 3.0% of Si, at least 0.2% and at most 2.0% of Mn, at most 0.03% of P, at most 0.03% of S, at least 0.3% and less tan 2.5% of Cr, at least 0.1% and less than 2.0% of Ni, at most 0.050% of Al, at most 0.003% of Ti, at most 0.0015% of O and at most 0.025% of N, and a remaining part of Fe and an unavoidable impurity, and the bearing component is prepared by performing carburizing carbo-nitriding process followed by quenching, and after quenching, tempering at a tempering temperature of at least 200° C. and at most 350° C., and surface hardness after tempering process is at least HRC57. Thus, an inexpensive heat resistant carburized rolling bearing component and manufacturing method thereof can be obtained, which realizes superior rolling fatigue life, wear resistance and dimensional stability under the environment involving foreign matters and high temperature.

2 Claims, 2 Drawing Sheets

HEAT RESISTANT CARBURIZED ROLLING BEARING COMPONENT AND MANUFACTURING METHOD THEREOF

BACKGROUND OF THE INVENTION

1. Field of the Invention

The present invention relates to a heat resistant carburized rolling bearing component and to a manufacturing method thereof.

2. Description of the Background Art

A rolling bearing used in a power transmitting portion or an engine portion of vehicles, airplanes, ships and boats, industrial machines and the like is used under a severe environment. Even under the severe environment, superior rolling fatigue life and reliability are required. In the rolling bearing used for the applications mentioned above, foreign matters such as particles, dusts and iron particles may possibly be involved, and in such an environment, the rolling fatigue life becomes significantly shorter than in a clean environment. As a countermeasure, recently, carbo-nitriding process is performed on high-carbon chromium bearing steel such as SUJ2 or a case-hardened steel such as SCM420 and SNCM815 to generate an appropriate amount of retained austenite immediately below the rolling surface, so as to improve life in an environment where foreign matters are involved.

General carbo-nitriding process, however, requires process time longer than the quenching and tempering process applied to SUJ2, for example, and therefore manufacturing cost of the rolling bearing subjected to the carbo-nitriding process is significantly increased as compared with the rolling bearing manufactured by the common quenching and tempering.

The rolling bearing used for vehicles and airplanes is used in an environment involving not only foreign matters but also high temperature. Therefore, excellent rolling fatigue life is required under very severe conditions of use. Generally, a rolling bearing used in a high temperature environment is prepared by quenching high-carbon chromium bearing steel such as SUJ2 followed by high temperature tempering to attain dimensional stability. High temperature tempering is also performed after carburization and quenching on the case-hardened steel such as SCM420 and SNCM815. When such materials are subjected to high temperature tempering, however, hardness degrades significantly, and therefore, a prescribed hardness required of a rolling bearing cannot be attained, resulting in shorter rolling fatigue life and lower wear resistance. For this reason, a precipitation hardening type steel material such as M50 is used for a rolling bearing used in a high temperature range. However, the cost of the material and manufacturing of such a rolling bearing is high, and in addition, the scope of application is limited, so that it has been impossible to satisfy various needs.

In a rolling bearing subjected to carbo-nitriding process, retained austenite is generated directly below the rolling portion after heat treatment, stress concentration caused by biting of foreign matters is relaxed by the function of the retained austenite, and in addition, resistance to temper softening is improved by nitrogen introduced to the steel, so as to improve rolling fatigue life. As described above, however, a rolling bearing used at a high temperature must be subjected to high temperature tempering, by which the retained austenite is decomposed and the amount thereof is reduced. Therefore the effect mentioned above is not expected. Further, there is a limit to prevent temper softening by the introduced nitrogen, and therefore sufficient performance cannot be attained in an environment involving foreign matters and high temperature.

Recently, development of an engine having high output and small size is in rapid progress in the field of vehicles, for example, and at the same time, the environment of use of the rolling bearing has become increasingly severe. The temperature range at which the rolling bearing is used in the engine portion is generally about 130° C. However, instantaneous increase of temperature to 160° C. is expected. As the engine comes to have higher output, the temperature range of the rolling bearing will be increased to about 160° C. for normal use and up to 200° C. or more instantaneously. Therefore, when higher output and reduction in weight of the engine are promoted, it would be impossible to maintain sufficient rolling fatigue life under the expected environment involving foreign matters and the high temperature, by the present high-carbon chromium bearing steel or by the carburizing or carbo-nitriding process.

Further, the precipitation hardening type bearing steel such as M50 is disadvantageous because of the high cost. Therefore, a rolling bearing that is inexpensive and has sufficient rolling fatigue life even under a severe environment of use is desired.

SUMMARY OF THE INVENTION

The present invention was made to solve the above-described problems, and an object is to provide a heat resistant carburized rolling bearing component having excellent rolling fatigue life, wear resistance and dimensional stability even under an environment involving foreign matters and an environment of high temperature, and is inexpensive as compared with the prior art examples, as well as to provide a manufacturing method thereof.

Through intensive study, the inventors of the present invention have found combinations and respective contents of composition elements that can provide inexpensive heat-resistant carburized rolling bearing component having excellent rolling fatigue life under the environment involving foreign matters and environment involving high temperature.

The present invention provides a component of a heat resistant carburized rolling bearing having an inner ring, an outer ring and a rolling element, formed of a steel material, at least containing, as alloy elements in a matrix, by mass %, at least 0.1% and at most 0.4% of C (carbon), at least 0.3% and at most 3.0% of Si (silicon), at least 0.2% and at most 2.0% of Mn (manganese), at most 0.03% of P (phosphorus), at most 0.03% of S (sulfur), at least 0.3% and less than 2.5% of Cr (chromium), at least 0.1% and less than 2.0% of Ni (nickel), at most 0.050% of Al (aluminum), at most 0.003% of Ti (titanium), at most 0.0015% of O (oxygen) and at most 0.025% of N (nitrogen) and a remaining part of Fe and an unavoidable impurity, formed by carburizing or carbo-nitriding process followed by quenching, followed in turn by tempering at a tempering temperature of at least 200° C. and at most 350° C., and having a surface hardness of at least HRC57 after the tempering process.

The heat resistant carburized rolling bearing component of the present invention having the above described composition can attain surface hardness as high as HRC57 or higher even after high temperature tempering, and therefore, satisfactory rolling fatigue life and wear resistance can be attained even under the environment involving high temperature and foreign matters. As high temperature tempering process is performed, retained austenite that is instable to heat can be decomposed in advance, and therefore, dimensional stability at a high temperature environment is ensured.

Further, the steel having the above described composition is inexpensive as compared with the precipitation hardening type bearing steel such as M50.

From the foregoing, it is understood that an inexpensive heat resistant carburized rolling bearing component having excellent rolling fatigue life, wear resistance and dimensional stability under the environment involving foreign matters and the environment involving high temperature can be obtained.

The temperature for tempering process is at least 200° C. and at most 350° C. A rolling bearing used in a high temperature environment may possibly heated to 200° C. or higher. Therefore, tempering process is performed at a temperature not lower than 200° C. to ensure dimensional stability. When the temperature for tempering process exceeds 350° C., surface hardness will be lower than HRC57, and the life of the rolling bearing abruptly decreases.

By performing carbo-nitriding process in place of carburizing process, it is possible to attain further improved rolling fatigue life, wear resistance and dimensional stability in the environment involving foreign matters and the environment of high temperature.

The reasons why the chemical components of the heat resistant carburized rolling bearing are limited will be described in the following.

(1) C Content (at least 0.1% and at most 0.4%)

C has an influence on core hardness after carburizing or carbonitriding process. In order to ensure the core hardness necessary to attain the required strength of a rolling bearing, it is necessary that C content is at least 0.1%. When the content of C exceeds 0.4%, toughness, susceptibility to hot working and machinability are degraded, and therefore, it is necessary to set the upper limit of C content to 0.4%.

(2) Si Content (at least 0.3% and at most 3.0%)

Si has a function of suppressing softening in a high temperature range and improving heat resistance of the rolling bearing. When Si content is smaller than 0.3%, such effect cannot be attained. Therefore, the lower limit of Si content must be 0.3%. As Si content increases, heat resistance also improves. The effect, however, is saturated when it is added exceeding 3.0%, while susceptibility of hot working and machinability are degraded. Therefore, it is necessary to set the upper limit of Si content to 3.0%.

(3) Mn Content (at least 0.2% and at most 2.0%)

Mn is an element used for deoxidation in manufacturing steel, and at the same time, it is an element that improves quenching property. To obtain such effects, it is necessary to add Mn by at least 0.2%. When the content exceeds 2.0%, however, machinability degrades significantly, and therefore, it is necessary to set the upper limit of Mn content to 2.0%.

(4) P Content (at most 0.03%)

P is segregated at austenite grain boundary of the steel, causing degradation of toughness and rolling fatigue life. Therefore, it is necessary to set the upper limit of P content to 0.03%.

(5) S Content (at most 0.03%)

S hinders susceptibility to hot working of steel and forms a non-metallic inclusion in the steel to degrade toughness and rolling fatigue life. Therefore, it is necessary to set the upper limit of S content to 0.03%. Though S is disadvantageous in the aspect described above, it has an effect of improving machinability. Therefore, though smaller content is desirable, it may be added within the range of at most 0.03%.

(6) Cr Content (at least 0.3% and less than 2.5%)

Cr has the effect of improving quenching property, improving resistance to temper softening and elongating life. In order to attain such effects, the contents must be at least 0.3%. When the content is at least 2.5%, however, large carbide generates, degrading rolling fatigue life.

(7) Al Content (at most 0.050%)

When a large amount of Al exceeding 0.050% is contained, hard oxide inclusion generates, significantly degrading rolling fatigue life. Though Al presents such a problem, it has an effect of making finer the crystal grains by forming AlN. Therefore, Al may be contained by the amount of 0.05% that may not increase manufacturing cost of the steel.

(8) N Content (at most 0.025%)

N has an effect of making finer the crystal grains by forming AlN, bonded to Al. When contained by a large amount, however, strength of the steel is degraded. Therefore, it is necessary to set the upper limit of N content to 0.025%.

(9) Ti Content (at most 0.003%)

Ti forms a nitride to be a non-metallic inclusion, possibly providing a start point of rolling fatigue. Therefore, it is necessary to set the upper limit of Ti content to 0.003%.

(10) O Content (at most 0.0015%)

O forms an oxide in the steel, possibly providing a start point of rolling fatigue as a non-metallic inclusion, resulting in shorter rolling fatigue life. Therefore, it is necessary to set the upper limit of O content to 0.0015%.

(11) Ni Content (at least 0.1% and less than 2.0%)

Ni suppresses change in texture in the process of rolling fatigue when used in a high temperature environment, and it also has an effect of improving rolling fatigue life by suppressing lowering of hardness in a high temperature range. In addition, Ni also has the effect of improving toughness to improve life in the environment involving foreign matters and improving corrosion resistance. To attain such effects, it is necessary to add Ni by at least 0.1%. When the content is at least 2.0%, however, large amount of retained austenite generates at the time of quenching, making it difficult to attain a prescribed hardness and, in addition, the cost of the steel material increases.

Tempering hardness and carbide of the heat resistance carburized rolling bearing will be discussed in the following.

(12) Tempering Hardness

In order to stabilize dimension under the environment of use, it is a general practice that a bearing used in a high temperature range is subjected to tempering at a temperature not lower than the environmental temperature. The inventors conducted detailed study related to the tempering hardness and the rolling fatigue life at the temperature environment of 200° C., and as a result, it was found that there was a correlation between the tempering hardness and the rolling fatigue life, and that there was a tendency that the harder the tempering hardness, the longer the rolling fatigue life. Particularly, it was found that when the tempering hardness was the same, a bearing subjected to tempering at a higher temperature had longer life, and even when subjected to high temperature tempering, a bearing having high tempering hardness had longer life. Further, it was found that when surface hardness after tempering was lower than HRC57, the life degraded abruptly, and variation in life increased. In order to improve life at a high temperature and to suppress variations, it is necessary to maintain the surface hardness of at least HRC57, and higher tempering temperature is preferred at this time.

Preferably, in the heat resistant carburized rolling bearing described above, the steel material further includes at least one of Mo (molybdenum) of at least 0.05% and at most 2.5% and V (vanadium) of at least 0.05% and at most 1.0%, both by mass %.

Thus, rolling fatigue life in the environment involving foreign matters and the environment involving high temperature can further be improved, and the hardness after tempering process can be improved.

The reasons why the chemical components described above are limited will be described in the following.

(13) Mo Content (at least 0.05% and at most 2.5%)

Mo has a function of improving quenching property of steel and preventing softening at the time of tempering process as it results in solid-solution in a carbide. Mo is added particularly because it is found to have the function of improving rolling fatigue life in a high temperature range. When a large amount of Mo exceeding 2.5% is contained, however, the cost of the steel material increases and hardness at the time of softening to ease cutting process is not lowered, resulting in significant degradation in machinability. Therefore, it is preferred to set the upper limit of Mo content to 2.5%. When the content of Mo is smaller than 0.05%, the effect in forming carbide is not attained. Therefore, it is preferred to set the lower limit of Mo content to 0.05%.

(14) V Content (at least 0.05% and at most 1.0%)

V is bonded to carbon, precipitating fine carbide, promotes development of fine crystal grains and has an effect of improving strength·toughness. Further, V content improves heat resistance of the steel material, suppresses softening after high temperature tempering, improves rolling fatigue life and reduces variations of life. The V content ensuring such effects is at least 0.05%. Therefore, it is preferred to set the lower limit of V content to 0.05%. When a large amount of V exceeding 1.0% is contained, machinability and susceptibility to hot working are degraded. Therefore, it is preferred to set the upper limit of V content to 1.0%.

In the above described heat resistant carburized rolling bearing, preferably, the total content of Mn and Ni in the steel material is at least 1.5%, by mass %. Thus, rolling fatigue life is significantly improved by performing secondary quenching after intermediate annealing, in addition to carburizing or carbo-nitriding process.

The present invention provides a method of manufacturing a heat resistant carburized rolling bearing, having an inner ring, an outer ring and a rolling element, including the following steps. First, a steel material is prepared, that steel material at least including, as alloy elements, at least 0.1% and at most 0.4% of C, at least 0.3% and at most 3.0% of Si, at least 0.2% and at most 2.0% of Mn, at most 0.03% of P, at most 0.03% of S, at least 0.3% and less than 2.5% of Cr, at least 0.1% and less than 2.0% of Ni, at most 0.050% of Al, at most 0.003% of Ti, at most 0.0015% of O and at most 0.25% of N, by mass %, and the remaining part including Fe and an unavoidable impurity. The steel material is subjected to carburizing or carbo-nitriding process followed by quenching. After quenching, the steel material is subjected to tempering at a temperature of at least 200° C. and at most 350° C.

In the method of manufacturing the heat resistant carburized rolling bearing of the present invention, the steel material having the above described composition is prepared. Therefore, even when it is subjected to high temperature tempering process, a high surface hardness of at least HRC57 can be attained, and therefore satisfactory rolling fatigue life and wear resistance can be attained even under the environment involving high temperature·foreign matters. Further, as the amount of retained austenite can be reduced by performing tempering process at a high temperature, dimensional stability in the high temperature environment can be secured.

Further, the steel having the above described composition is inexpensive as compared with the precipitation hardening type steel such as M50.

From the foregoing, it is possible to manufacture an inexpensive heat resistant carburized rolling bearing having superior rolling fatigue life, wear resistance and dimensional stability in the environment involving foreign matters and in the environment involving high temperature.

Preferably, in the method of manufacturing the heat resistant carburized rolling bearing described above, the quenched steel material is subjected to secondary quenching and thereafter subjected to tempering process.

Thus, sufficient surface hardness can be attained.

Preferably, in the method of manufacturing the heat resistant carburized rolling bearing described above, the quenched steel material is subjected to an intermediate annealing, and thereafter subjected to secondary quenching.

Thus, sufficient surface hardness can be attained.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described with reference to the figures.

Figure 1:
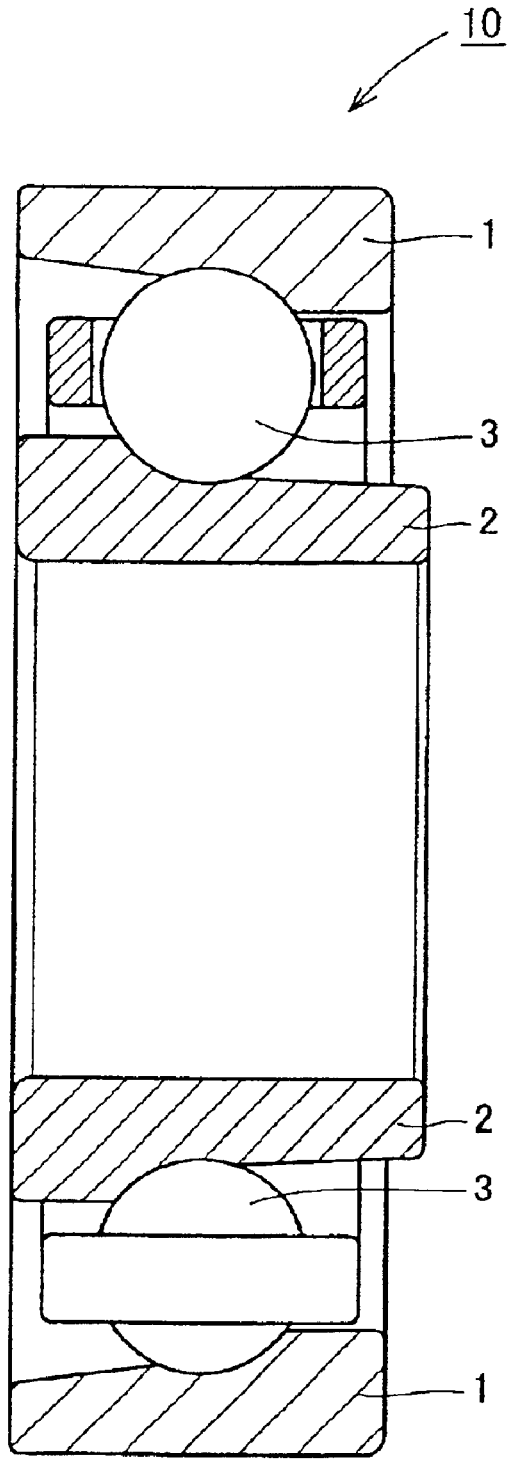
FIG. 1 is a schematic cross section showing a structure of a heat resistant carburized rolling bearing in accordance with one embodiment of the present invention.

Referring to FIG. 1, the heat resistant carburized rolling bearing 10 mainly includes an outer ring 1, an inner ring 2 and a rolling element 3. Rolling element 3 is supported in a rollable manner by a cage between outer ring 1 and inner ring 2.

At least one of outer ring, inner ring 2 and rolling element 3 at least contains in the matrix, as alloy elements, at least 0.1% and at most 0.4% of C, at least 0.3% and at most 3.0% of Si, at least 0.2% and at most 2.0% of Mn, at most 0.03% of P, at most 0.03% of S, at least 0.3% and less than 2.5% of Cr, at least 0.1% and less than 2.0% of Ni, at most 0.050% of Al, at most 0.003% of Ti, at most 0.0015% of O and at most 0.025% of N, all by mass %, and the remaining part of Fe and an unavoidable impurity. As the steel material is subjected to carburizing or carbo-nitriding process, the material has on its surface a carburized layer or a carbo-nitrided layer. In the carburized layer, carbon concentration is higher than in the matrix, and in the carbo-nitride layer, the carbon concentration and the nitride concentration are higher than in the matrix. The steel material has a structure that is subjected to carburizing or carbon-nitriding process, followed by quenching, and after quenching, further subjected to tempering process at a tempering temperature of at least 200° C. and at most 350° C. Surface hardness of the steel material is at least HRC57, and the amount of retained austenite at the surface layer portion is at most 35 vol %.

Preferably, the steel material described above further includes at least one of at least 0.05% and at most 2.5% of Mo (molybdenum) and at least 0.05% and at most 1.0% of V (vanadium), both by mass %.

The method of manufacturing the heat resistant carburized rolling bearing in accordance with the embodiment of the present invention will be described in the following.

Figure 2:
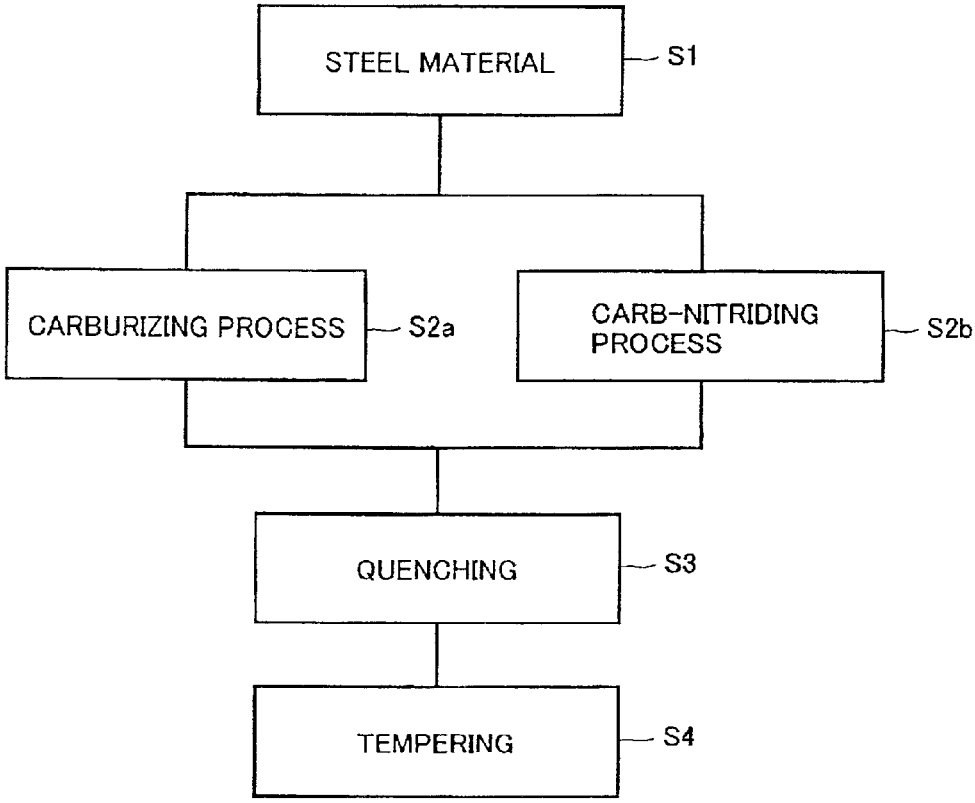
FIG. 2 is a flow chart representing the method of manufacturing the heat resistant carburized rolling bearing in accordance with one embodiment of the present invention.

Referring to FIG. 2, a steel member that will be at least one of outer ring 1, inner ring 2 and rolling element 3 is prepared to have the above described composition (step 1). The steel material is subjected to carburization or carbo-nitriding process (step S2a, S2b). Thereafter, the steel material is subjected to quenching (step S3) and tempering (step S4), so that at least one of outer ring 1, inner ring 2 and rolling element 3 is manufactured.

Figure 3:
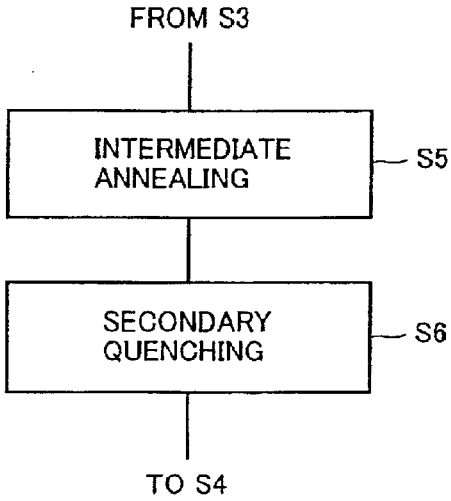
FIG. 3 shows addition of the steps of intermediate annealing and secondary quenching after the step of quenching shown in FIG. 2.

When sufficient surface hardness is not obtained after carburization or carbo-nitriding process, an intermediate annealing (step S5) may be performed, followed by secondary quenching (step S6), as shown in FIG. 3, after the step of quenching (step S3).

Dependent on the type of the steel material, intermediate annealing (step S5) may be omitted, and, in that case, only the secondary quenching (step S6) may be performed.

Rolling fatigue life of a steel material having the total content of Mn and Ni of at least 1.5 mass % can further be improved by performing intermediate annealing (step S5) and the secondary quenching (step S6) after the quenching process (step S3).

Experimental examples of the present invention will be described in the following.

Steel materials having such chemical compositions as listed in Table 1 were melt by a vacuum induction furnace, cast into steel ingots each of 150 kg, melted at a temperature of 1200° C. for 3 hours to perform hot purging, and round bars having the diameter of 50 mm were manufactured. The round bar materials were subjected to carbo-nitriding process in which the materials were kept at 850° C. for one hour, followed by air-cooling, and thereafter the round bar materials were subjected to softening process to ease cutting process, in which the materials were kept at 780° C. for 6 hours, cooled to 650° C. at the cooling rate of 10° C./hour and air-cooled to the room temperature. Thus prepared materials were the objects of various test.

TABLE 1

| | | | Chemical Composition (mass %) | | | | | | | | | | | | |
|---|---|---|---|---|---|---|---|---|---|---|---|---|---|---|---|
| No | Steel type | | C | Si | Mn | P | S | Ni | Cr | Mo | V | Al | Ti | O | N |
| 1 | A | Present | 0.18 | 0.75 | 0.50 | 0.017 | 0.019 | 0.54 | 1.58 | — | — | 0.022 | 0.0023 | 0.0010 | 0.015 |
| 2 | B | Invention | 0.20 | 2.01 | 0.41 | 0.018 | 0.015 | 1.10 | 2.02 | — | — | 0.028 | 0.0025 | 0.0012 | 0.014 |
| 3 | C | | 0.35 | 0.54 | 0.25 | 0.015 | 0.020 | 0.79 | 1.03 | — | — | 0.021 | 0.0029 | 0.0008 | 0.013 |
| 4 | D | | 0.19 | 0.76 | 1.03 | 0.021 | 0.012 | 1.98 | 1.51 | — | — | 0.028 | 0.0022 | 0.0012 | 0.014 |
| 5 | E | | 0.21 | 2.00 | 0.41 | 0.018 | 0.018 | 1.85 | 0.55 | — | — | 0.019 | 0.0025 | 0.0010 | 0.016 |
| 6 | F | | 0.30 | 2.55 | 0.46 | 0.017 | 0.019 | 1.90 | 1.56 | — | — | 0.022 | 0.0023 | 0.0011 | 0.015 |
| 7 | G | | 0.22 | 0.53 | 1.95 | 0.019 | 0.017 | 0.75 | 0.75 | 0.51 | — | 0.030 | 0.0028 | 0.0009 | 0.014 |
| 8 | H | | 0.20 | 1.49 | 0.55 | 0.020 | 0.015 | 1.65 | 0.51 | 1.55 | — | 0.027 | 0.0027 | 0.0008 | 0.013 |
| 9 | I | | 0.19 | 1.04 | 0.78 | 0.018 | 0.009 | 1.03 | 0.75 | — | 0.45 | 0.025 | 0.0025 | 0.0011 | 0.014 |
| 10 | J | | 0.25 | 0.65 | 1.53 | 0.021 | 0.013 | 1.51 | 2.23 | — | 0.91 | 0.019 | 0.0023 | 0.0010 | 0.015 |
| 11 | K | | 0.33 | 1.35 | 0.78 | 0.018 | 0.022 | 0.56 | 1.79 | — | — | 0.025 | 0.0024 | 0.0010 | 0.013 |
| 12 | L | Comparative | 0.20 | 0.21 | 0.75 | 0.018 | 0.018 | 0.02 | 1.05 | — | — | 0.023 | 0.0029 | 0.0009 | 0.014 |
| 13 | M | Examples | 0.19 | 0.55 | 0.15 | 0.019 | 0.017 | 0.60 | 0.22 | — | — | 0.005 | 0.0027 | 0.0009 | 0.015 |
| 14 | N | | 0.19 | 4.01 | 0.44 | 0.019 | 0.021 | 0.79 | 2.00 | — | — | 0.028 | 0.0025 | 0.0008 | 0.013 |
| 15 | O | | 0.49 | 1.03 | 0.83 | 0.021 | 0.015 | 1.50 | 1.03 | — | 0.39 | 0.022 | 0.0027 | 0.0010 | 0.015 |
| 16 | P | | 0.29 | 1.55 | 0.55 | 0.055 | 0.041 | 0.50 | 1.35 | — | — | 0.028 | 0.0027 | 0.0011 | 0.013 |
| 17 | Q | | 0.20 | 1.01 | 2.52 | 0.018 | 0.019 | 2.45 | 1.97 | 0.53 | — | 0.029 | 0.0022 | 0.0010 | 0.016 |
| 18 | R | | 0.22 | 0.98 | 1.00 | 0.018 | 0.020 | 1.00 | 6.03 | 1.02 | — | 0.025 | 0.0027 | 0.0009 | 0.013 |
| 19 | S | | 0.31 | 0.75 | 0.55 | 0.019 | 0.013 | 4.03 | 0.79 | — | 2.00 | 0.027 | 0.0023 | 0.0008 | 0.015 |
| 20 | T | | 0.22 | 0.22 | 1.55 | 0.015 | 0.011 | 0.55 | 1.04 | — | — | 0.022 | 0.0026 | 0.0010 | 0.013 |
| 21 | U | | 0.21 | 1.01 | 0.35 | 0.017 | 0.019 | 1.60 | 1.01 | — | — | 0.061 | 0.0055 | 0.0025 | 0.033 |
| 22 | V | | 0.31 | 1.05 | 0.80 | 0.018 | 0.017 | 0.77 | 1.15 | — | — | 0.025 | 0.0026 | 0.0011 | 0.014 |
| 23 | W | | 0.22 | 0.77 | 1.03 | 0.018 | 0.013 | 1.05 | 1.10 | — | — | 0.023 | 0.0027 | 0.0009 | 0.015 |

In order to confirm performance as a bearing component, fatigue test was performed by using a thrust type rolling fatigue life tester, and the life of various materials were evaluated.

As the test pieces used for life evaluation, thrust type rolling fatigue life test pieces each having a ring-shape with the outer diameter of 47 mm, inner diameter of 29 mm and the thickness of 7 mm, machine-processed from the round bar material having diameter of 50 mm and roughly processed, were used.

As to the heat treatment of the roughly processed test pieces, carburizing, quenching and tempering processes were performed by using a gas atmosphere furnace, in which the test pieces were held at 950° C. for 300 minutes with carbon potential of 1.0% to 1.2% in RX gas atmosphere, the temperature was lowered to 900° C. and oil-quenching was performed. Thereafter, tempering process was performed for 120 minutes. The tempering temperatures were as shown in Tables 2 and 3.

TABLE 2

| No | Steel type | Process | Tempering Temperature (° C.) | | Surface Hardness (HRC) | Ratio of rolling fatigue life at room temperature | Ratio of rolling fatigue life at 200° C. | Ratio of rolling life with foreign matters room temperature | Ratio of rolling life with foreign matters 200° C. |
|---|---|---|---|---|---|---|---|---|---|
| 1 | A | Carburization | 250 | Present Invention | 59.4 | 3.1 | 3.3 | 3.3 | 3.6 |
| | | Carbo-nitriding | 250 | | 60.0 | 3.3 | 4.1 | 3.7 | 4.1 |
| 2 | B | Carburization | 250 | | 61.5 | 3.3 | 4.4 | 3.1 | 4.4 |
| | | Carbo-nitriding | 250 | | 62.1 | 3.5 | 5.2 | 3.3 | 5.5 |
| 3 | C | Carburization | 250 | | 61.2 | 2.5 | 3.5 | 2.4 | 3.9 |
| | | Carbo-nitriding | 250 | | 62.0 | 2.9 | 3.9 | 2.3 | 4.3 |
| 4 | D | Carburization + Secondary quenching | 330 | | 58.7 | 2.6 | 6.2 | 4.7 | 7.7 |
| | | Carbo-nitriding + Secondary quenching | 330 | | 59.1 | 3.2 | 7.0 | 5.0 | 8.5 |
| 5 | E | Carburization + Intermediate annealing + Secondary quenching | 250 | | 60.8 | 50.0 | 10.5 | 5.2 | 13.2 |
| | | Carbo-nitriding + Intermediate annealing + Secondary quenching | 250 | | 61.1 | 6.3 | 11.3 | 5.5 | 13.7 |
| 6 | F | Carburization + Secondary quenching | 250 | | 59.5 | 3.6 | 6.5 | 6.0 | 8.7 |
| | | Carbo-nitriding + Secondary quenching | 250 | | 60.0 | 4.7 | 7.3 | 6.3 | 9.5 |
| 7 | G | Carburization + Intermediate annealing + Secondary quenching | 250 | | 61.2 | 5.0 | 9.4 | 5.1 | 10.4 |
| | | Carbo-nitriding + Intermediate annealing + Secondary quenching | 250 | | 61.4 | 5.1 | 10.3 | 4.9 | 11.1 |
| 8 | H | Carburization + Intermediate annealing + Secondary quenching | 250 | | 60.1 | 5.6 | 11.9 | 6.3 | 12.3 |
| | | Carbo-nitriding + Intermediate annealing + Secondary quenching | 250 | | 62.7 | 6.5 | 12.5 | 6.6 | 12.7 |
| 9 | I | Carburization | 250 | | 61.2 | 5.0 | 7.7 | 5.9 | 8.8 |
| | | Carbo-nitriding | 250 | | 61.3 | 4.9 | 6.9 | 6.5 | 9.5 |
| 10 | J | Carburization + Intermediate annealing + Secondary quenching | 300 | | 59.8 | 6.8 | 13.5 | 7.7 | 14.0 |
| | | Carbo-nitriding + Intermediate annealing + Secondary quenching | 300 | | 59.6 | 6.5 | 14.0 | 8.1 | 14.5 |
| 11 | K | Carburization | 250 | | 60.3 | 3.5 | 3.5 | 4.0 | 3.9 |
| | | Carbo-nitriding | 250 | | 59.5 | 3.9 | 4.8 | 4.7 | 4.2 |

TABLE 3

| No | Steel type | Process | Tempering Temperature (° C.) | | Surface Hardness (HRC) | Ratio of rolling fatigue life at room temperature | Ratio of rolling fatigue life at 200° C. | Ratio of rolling life with foreign matters room temperature | Ratio of rolling life with foreign matters 200° C. |
|---|---|---|---|---|---|---|---|---|---|
| 12 | L | Carburization | 250 | Com-parative Examples | 60.0 | 1.0 | 1.0 | 1.0 | 1.0 |
| | | Carbo-nitridhig | 250 | | 60.5 | 1.5 | 1.3 | 1.5 | 1.6 |
| 13 | M | Carburization | 250 | | 59.4 | 1.2 | 1.1 | 1.2 | 1.4 |
| | | Carbo-nitriding | 250 | | 60.0 | 1.6 | 1.5 | 1.8 | 1.5 |
| 14 | N | Carburization + Secondary quenching | 250 | | 58.4 | 1.5 | 1.3 | 2.3 | 1.9 |
| | | Carbo-nitriding + Secondary quenching | 250 | | 59.8 | 1.9 | 1.6 | 2.9 | 2.4 |
| 15 | O | Carburization | 250 | | 59.1 | 1.3 | 1.2 | 1.6 | 1.5 |
| | | Carbo-nitriding | 250 | | 60.2 | 1.5 | 1.5 | 1.8 | 1.6 |
| 16 | P | Carburization | 250 | | 60.1 | 0.3 | 0.2 | 0.6 | 0.5 |
| | | Carbo-nitriding | 250 | | 61.9 | 0.4 | 0.4 | 0.5 | 0.4 |
| 17 | Q | Carburization + Intermediate annealing + Secondary quenching | 250 | | 59.5 | 1.3 | 1.5 | 2.1 | 2.4 |
| | | Carbo-nitriding + Intermediate annealing + Secondary quenching | 250 | | 59.7 | 1.8 | 1.8 | 2.4 | 2.9 |
| 18 | R | Carburization + Intermediate annealing + Secondary quenching | 250 | | 60.4 | 1.2 | 1.3 | 1.9 | 1.8 |
| | | Carbo-nitriding + Intermediate annealing + Secondary quenching | 250 | | 60.2 | 1.5 | 1.4 | 2.3 | 2.3 |
| 19 | S | Carburization + Intermediate annealing + Secondary quenching | 300 | | 55.1 | 1.1 | 1.2 | 1.8 | 1.7 |
| | | Carbo-nitriding + Intermediate annealing + Secondary quenching | 300 | | 56.2 | 1.9 | 1.3 | 2.3 | 2.1 |
| 20 | T | Carburization + Secondary quenching | 300 | | 57.4 | 1.3 | 0.9 | 1.7 | 1.3 |
| | | Carbo-nitriding + Secondary quenching | 300 | | 57.3 | 1.4 | 0.6 | 2.0 | 0.9 |
| 21 | U | Carburization | 250 | | 60.8 | 0.5 | 0.4 | 0.7 | 0.6 |
| | | Carbo-nitriding | 250 | | 60.5 | 0.4 | 0.5 | 0.6 | 0.7 |
| 22 | V | Carburization | 180 | | 61.5 | 2.0 | 0.6 | 2.9 | 0.5 |
| | | Carbo-nitriding | 180 | | 62.2 | 2.3 | 0.9 | 3.0 | 0.7 |
| 23 | W | Carburization | 400 | | 54.1 | 0.3 | 0.7 | 0.5 | 0.9 |
| | | Carbo-nitriding | 400 | | 55.0 | 0.4 | 1.0 | 0.8 | 1.2 |

After the carburizing process described above, carbo-nitriding process was performed using a gas atmosphere furnace, in which test pieces were held at 850° C. for 120 minutes with the carbon potential of 1.0% to 1.2% and the amount of $NH_3$ of 5% to 10% in an RX gas atmosphere, and thereafter, the test pieces were subjected to oil-quenching. Thereafter, tempering process for 120 minutes was performed. The tempering temperatures were as shown in Tables 2 and 3.

Those test pieces which did not have sufficient surface hardness after carburizing or carbo-nitriding process followed by quenching and tempering processes were subjected, after quenching, to intermediate annealing in which the test pieces were held at 650° C. for 60 minutes, and thereafter cooled gradually in the furnace. Thereafter, secondary quenching was performed in a salt furnace at 850° C. for 30 minutes, and the test pieces were subjected to oil-quenching. For some of the test pieces, the intermediate annealing could be omitted, and only the secondary quenching was performed under the same condition. Thereafter, tempering process for 120 minutes was performed. The tempering temperatures were as shown in Tables 2 and 3.

After the end of heat treatment, opposing surfaces of each test piece was polished to mirror-finish. Processing margin at the polishing process was 0.1 mm for both surfaces.

As to the surface hardness, surface hardness of the test pieces was measured by using a Rockwell hardness meter, and an average value of 7 points was calculated as the surface hardness.

Rolling fatigue life test was performed by a thrust type rolling fatigue life tester. Conditions of the test are as shown in Table 4. The test was performed in a room temperature environment and in an environment at 200° C., and further, in an environment simulating involvement of foreign matters.

TABLE 4

Conditions of Rolling Fatigue Life Test

| Tester | Thrust Type Rolling Fatigue Life Tester |
|---|---|
| Contact Surface Pressure | 5.0 GPa |
| Speed of Rotation | 2000 rpm. |
| Test Temperature | Room Temperature, 200° C. |
| Lubricant | Turbo Oil |
| Amount of Foreign Matters | None, 0.4 g/1000 cc |

As the fatigue test, cyclic testing under the same condition was performed 15 times, and the life at which cumulative damage ratio of Weibull probability attains 10% was determined to be the life of each material. Comparative Example No. 12 represents general purpose SCr420, and the life value of each material was represented as a ratio with respect to the life of this example, which is represented by 1.0.

The results of the surface hardness after tempering, rolling life at the room temperature and at 200° C. and the rolling fatigue life under the condition involving foreign matters are as shown in Tables 2 and 3, in which Table 2 shows the results of the present invention and Table 3 shows the results of comparative examples.

From the result shown in Tables 2 and 3 above, it was found that even when tempering process at the temperature of at least 200° C. and at most 350° C. was performed, examples of the present invention having the compositions within the range of the present invention, the surface hardness of at least HRC57 could be attained. It was found that when subjected to simple carburizing process, the examples of the present invention exhibited improved rolling fatigue life at the room temperature and at 200° C. and improved rolling fatigue life under the condition involving foreign matters, as compared with the comparative examples. Further, it was found that even when carbo-nitriding process was performed in place of the carburizing process, superior rolling fatigue life was obtained.

Further, it was found that by performing secondary quenching after intermediate annealing in addition to the carburizing or carbo-nitriding process, the rolling fatigue life could further be improved. It was found that when intermediate annealing was omitted and secondary quenching was performed after the carburizing or carbo-nitriding process, the rolling fatigue life could be improved.

Further, it was found that when secondary quenching was performed after intermediate annealing in addition to the carburizing or carbo-nitriding process on the steel material having the amount of Mn+Ni (total content) of at least 1.5%, the rolling fatigue life could be significantly improved.

Further, it was found that when the tempering temperature was lower than 200° C., rolling fatigue life at a room temperature was relatively satisfactory, while rolling fatigue life at 200° C. was deteriorated. When the tempering process at a temperature exceeding 350° C. was performed, surface hardness was degraded and rolling fatigue life was degraded.

As described above, as the inventors of the present invention have found optimal composition elements and contents thereof, an inexpensive, heat resistant carburized rolling bearing component can be obtained that realizes superior rolling fatigue life under the condition involving foreign matters by carburizing, quenching and tempering process, without the necessity of carbo-nitriding process and that attains high hardness even when subjected to tempering at a high temperature (for example 250° C.).

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of manufacturing a heat resistant carburized rolling bearing component having an inner ring, an outer ring and a rolling element, comprising the steps of:

preparing a steel material at least containing as alloy elements, by mass %, at least 0.1% and at most 0.4% of C, at least 0.53% and at most 3.0% of Si, at least 0.2% and at most 2.0% of Mn, at most 0.03% of P, at most 0.03% of S, at least 0.3% and less than 2.5% of Cr, at least 0.1% and less than 2.0% of Ni, at most 0.050% of Al, at most 0.003% of Ti, at most 0.0015% of O and at most 0.025% of N and a remaining part of Fe and an unavoidable impurity;

performing carburizing or carbo-nitriding process on said steel material followed by quenching; and after said quenching, performing tempering process on said steel material at a temperature of at least 250° C. and at most 350° C., wherein each of said inner ring, said outer ring and said rolling element formed from said steel material, wherein:

said tempering process is performed after said quenched steel material is subjected to secondary quenching, and said secondary quenching is performed after said quenched steel material is subjected to intermediate annealing.

2. The method of manufacturing a heat resistant carburized rolling bearing component according to claim 1, wherein in said step of preparing the steel material, said steel material is prepared such that total content of Mn and Ni is at least 1.5 mass %.

* * * * *